US009883725B1

(12) United States Patent
Freig

(10) Patent No.: US 9,883,725 B1
(45) Date of Patent: Feb. 6, 2018

(54) WALL-MOUNTED HAIR DRYER

(71) Applicant: Abraham Freig, Phoenix, AZ (US)

(72) Inventor: Abraham Freig, Phoenix, AZ (US)

( * ) Notice: Subject to any disclaimer, the term of this patent is extended or adjusted under 35 U.S.C. 154(b) by 567 days.

(21) Appl. No.: 14/292,855

(22) Filed: May 31, 2014

Related U.S. Application Data

(60) Provisional application No. 61/830,080, filed on Jun. 1, 2013.

(51) Int. Cl.
*A45D 20/12* (2006.01)
*A45D 20/00* (2006.01)

(52) U.S. Cl.
CPC ..... *A45D 20/00* (2013.01)

(58) Field of Classification Search
CPC ..... A45D 20/12; A45D 20/14; A45D 20/16; A45D 2020/126; A45D 42/00
USPC ..... 34/98, 96, 283; 132/304, 102, 106, 295, 132/301, 316, 103
See application file for complete search history.

(56) References Cited

U.S. PATENT DOCUMENTS

| | | | | | |
|---|---|---|---|---|---|
| 4,161,955 | A * | 7/1979 | Webb | A45D 20/08 | 132/271 |
| 4,746,090 | A * | 5/1988 | Hamilton | A45D 20/12 | 248/314 |
| 6,349,484 | B1 * | 2/2002 | Cohen | A47K 10/48 | 34/225 |
| 6,390,424 | B1 * | 5/2002 | Kidushim | A45D 20/12 | 248/122.1 |
| 2003/0211821 | A1 * | 11/2003 | Driller | B60H 1/345 | 454/124 |
| 2005/0167563 | A1 * | 8/2005 | Delaney | A45D 20/12 | 248/475.1 |
| 2010/0012799 | A1 * | 1/2010 | Sexton | F16M 11/10 | 248/205.4 |

* cited by examiner

*Primary Examiner* — John McCormack
(74) *Attorney, Agent, or Firm* — Kenneth L Tolar

(57) ABSTRACT

A wall-mounted hair dryer includes a housing having at least one outer wall with a turbo air blower received therein. On the outer wall are a pair of control switches for adjusting both the blower speed and the intensity of an internal heater. At the upper end of the housing is a manifold in fluid communication with the air blower. The manifold includes at least a left, a right and a central conduit, each having an outlet with an adjustable, louvered nozzle mounted thereon. The nozzles surround an adjustable mirror for assisting a user with styling the hair. The blower housing is mounted on a wall or door using one of three mounting brackets.

6 Claims, 3 Drawing Sheets

WALL-MOUNTED HAIR DRYER

CROSS REFERENCE TO RELATED APPLICATIONS

This application is entitled to the benefit of provisional patent application No. 61/830,080 filed on Jun. 1, 2013, the specification of which is incorporated herein by reference.

BACKGROUND OF THE INVENTION

The present invention relates to a wall-mounted hair dryer that frees a user's hands for other tasks.

DESCRIPTION OF THE PRIOR ART

A conventional blow dryer must be held in one hand while the hair is styled with the other. Complicated hair styles may require the dryer to be repeatedly placed onto and retrieved from a support surface, which is burdensome and inconvenient. For those with arthritis, Parkinson's disease or similar ailments, using a conventional blow dryer without assistance may be impossible.

Accordingly, there is currently a need for a hair dryer that is easier to operate than a conventional, handheld blow dryer. The present invention addresses this need by providing a wall-mounted hair dryer having repositionable air nozzles surrounding an adjustable mirror for conveniently drying the hair without using the hands.

SUMMARY OF THE INVENTION

The present invention relates to a wall-mounted hair dryer comprising a housing having at least one outer wall with a turbo air blower received therein. On the outer wall are a pair of control switches for adjusting the blower speed and the intensity of an internal heater. At the upper end of the housing is a manifold in fluid communication with the air blower. The manifold includes at least a left, a right and a central conduit, each having an outlet with an adjustable, louvered nozzle mounted thereon. The nozzles surround an adjustable mirror for assisting a user with styling the hair. The blower housing is mounted on a wall or door using one of three mounting brackets.

It is therefore an object of the present invention to provide a hair dryer that is mounted on a wall to free a user's hands for other tasks.

It is another object of the present invention to provide a wall-mounted hair dryer having adjustable air nozzles surrounding a mirror to allow a user to easily project hot air to a desired location.

Other objects, features, and advantages of the present invention will become readily apparent from the following detailed description of the preferred embodiment when considered with the attached drawings and the appended claims.

DESCRIPTION OF THE PREFERRED EMBODIMENT

Figure 1:
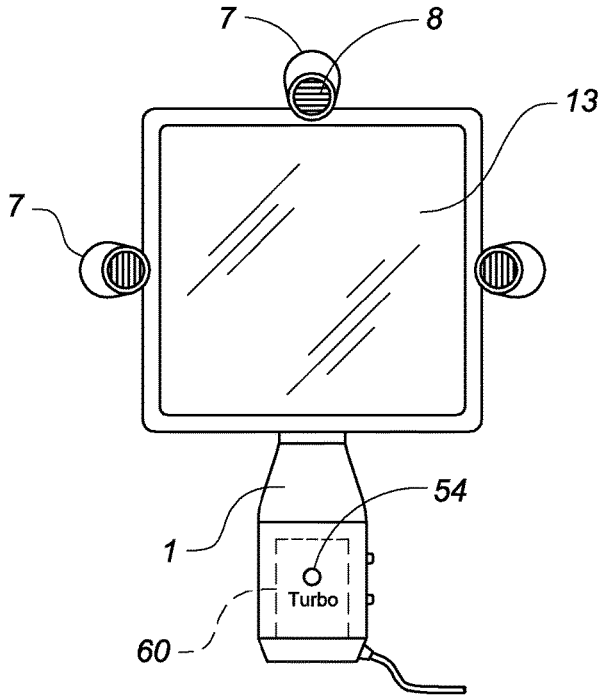
FIG. 1 is a front, plan view of the hair dryer according to the present invention.
Figure 2:
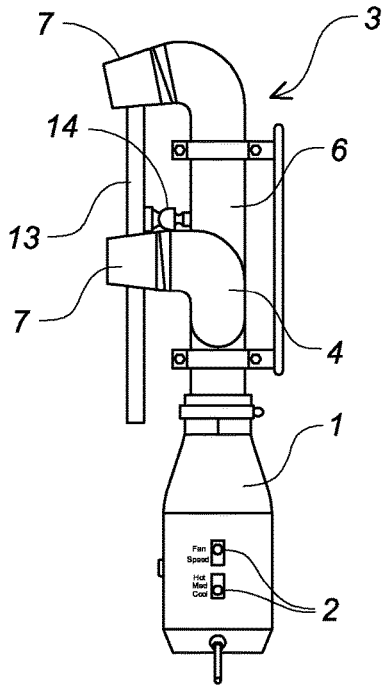
FIG. 2 is a side view of the hair dryer.
Figure 3:
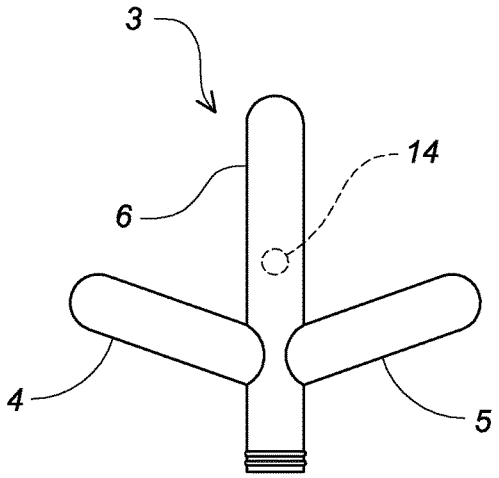
FIG. 3 is an isolated view of the manifold.
Figure 4:
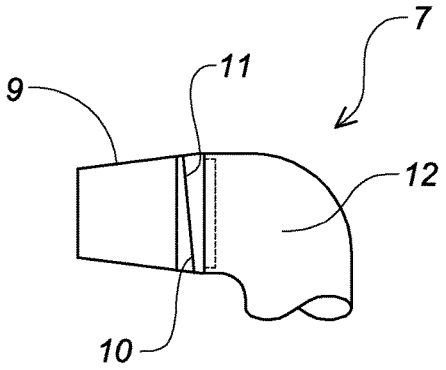
FIG. 4 is an isolated view of an exemplary air-delivery nozzle.
Figure 5:
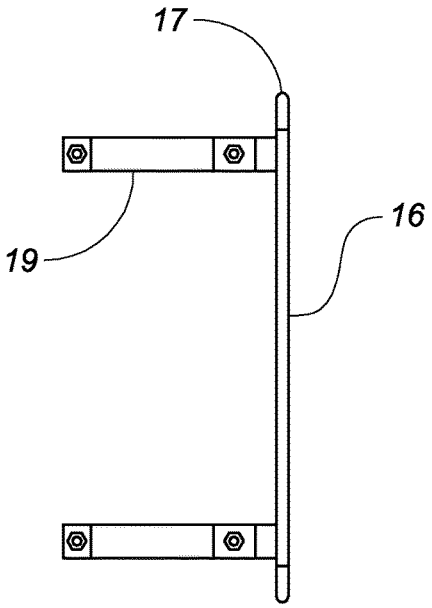
FIG. 5 is an isolated, side view of a first mounting bracket.
Figure 6:
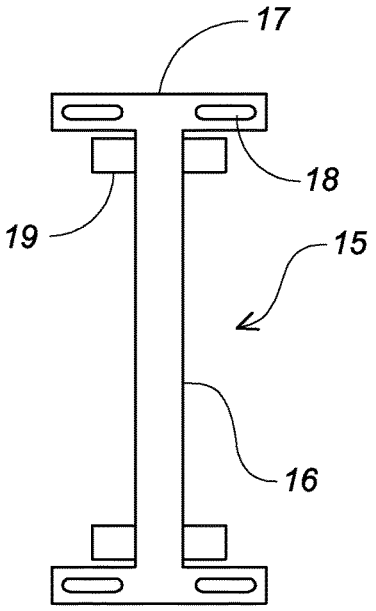
FIG. 6 is an isolated, rear view of the first mounting bracket.
Figure 7:
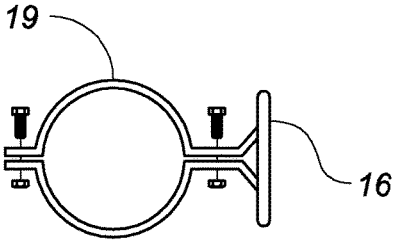
FIG. 7 is an isolated, top view of the first mounting bracket.
Figure 8:
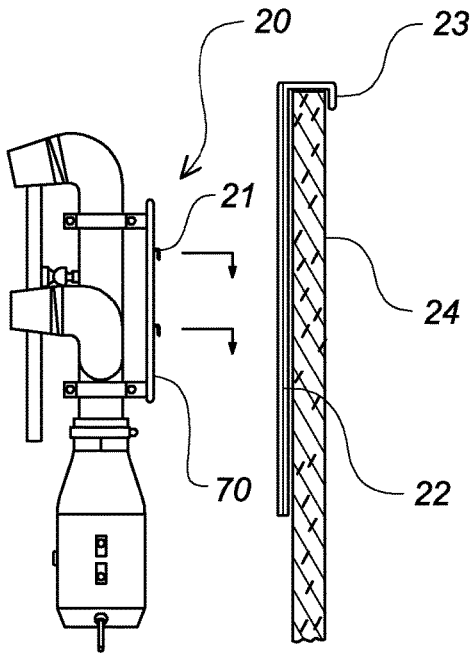
FIG. 8 is a side view of a second mounting bracket.
Figure 9:
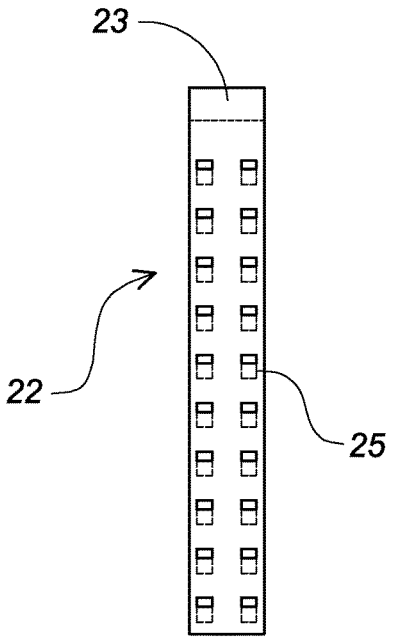
FIG. 9 is front, plan view of the second mounting bracket.
Figure 10:
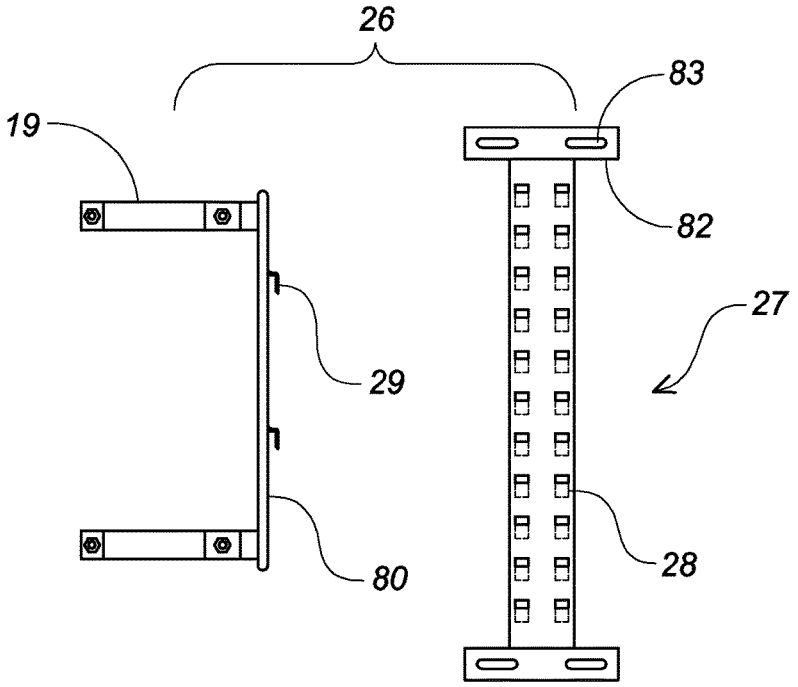
FIG. 10 is a front, plan view of a third mounting bracket and associated spine.

The present invention relates to a wall-mounted hair dryer comprising a housing 1 having at least one outer wall with a turbo air blower 60 received therein. On the outer wall are a pair of control switches 2 for adjusting both the intensity of an internal heater and the blower speed. Furthermore, a button 54 allows a user to selectively activate the turbo blower or to operate the dryer using a normal blower speed. Preferably, the heater is infused with tourmaline, titanium dioxide and silver for eradicating bacteria from the heated air and for shining the user's hair. The air intake to the blower/heater includes a screen and a replaceable or washable filter for removing particulates.

At the upper end of the housing is a manifold 3 in fluid communication with the air blower. The manifold includes at least a left 4, a right 5 and a central conduit 6, each having an outlet with an air-delivery nozzle 7 mounted thereon. Each nozzle includes adjustable louvers 8 for redirecting or completely disabling airflow, if desired. The louvers are mounted within a first section 9 having a chamfered rear surface 10 that abuts a chamfered front surface 11 on an adjacent section 12. Therefore, as the first section is rotated, the nozzle changes directions to allow a user to redirect hot air, as desired. Furthermore, the louvers pivot within the first section to allow further adjustment. There is minimal friction between the louvers and first section so that the louvers can be easily pivoted but will remain in a select position when released.

The nozzles surround an adjustable mirror 13 for assisting a user with styling the hair. On a rear surface of the mirror is a ball-and-socket joint 14 that is attached to the central conduit on the manifold.

The blower housing is mounted on a wall or door using one of three mounting brackets. A first bracket 15 includes a central, I-shaped spine 16 having a cross member 17 at both the upper end and the lower end. Each cross member includes several slots 18 for receiving fasteners that attach the bracket to a wall. Extending from the front surface of the spine are a pair of adjustable, circular clamps 19 for gripping the housing exterior.

A second bracket 20 is configured to fasten the blower housing to a door and includes a plurality of tabs 21 on the rear surface of a linear spine 70. A receiver plate 22 includes an L-shaped latch 23 on an upper end that fits over the upper edge of a door 24. The receiver plate includes a plurality of cavities 25 longitudinally formed thereon that are positioned and dimensioned to receive the tabs on the spine. Therefore, the spine can be secured at a desired position on the receiver plate to mount the blower housing at a desired height.

A third bracket 26 includes a receiver plate 27 having cross members 82 and slots 83 for fixedly attaching the receiver plate 27 to a wall with fasteners, in a similar manner as the first bracket. The receiver plate includes cavities 28 longitudinally disposed thereon that receive tabs 29 on the rear surface of a linear spine 80 to adjustably mount the housing on a wall.

The above-described device is not limited to the exact details of construction and enumeration of parts provided herein. For example, though the device has been primarily depicted and described as being a stand-alone unit, the device may not include an integral blower. Instead, several adapters would allow a conventional, handheld blow-drier to be attached to the device. Furthermore, the size, shape and materials of construction of the various components can be varied.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A wall-mounted hair dryer comprising:

a housing having a hot-air blower received therein and a hot-air outlet in communication with said hot-air blower;

a plurality of adjustable air-delivery nozzles, each of said air-delivery nozzles positioned on an outlet of a conduit that is in fluid communication with said hot-air blower;

a mirror adjustably mounted on the conduit of one of said air-delivery nozzles with said air-delivery nozzles surrounding said mirror; wherein said mirror includes a ball-and-socket joint on a rear surface that is attached to the conduit so that said mirror is adjustable relative thereto;

means for mounting said housing on an upright support surface.

2. The wall-mounted dryer according to claim 1 wherein each of said air-delivery nozzles includes adjustable, pivotal louvers for redirecting and completely disabling airflow.

3. The wall-mounted dryer according to claim 2 wherein said conduit includes a first conduit section with said louvers received therein, said first conduit section having a chamfered rear surface that abuts a chamfered front surface on a contiguous, adjacent, second conduit section whereby as the first conduit section is rotated, the louvers are redirected to allow a user to project hot air to a desired location.

4. The wall-mounted dryer according to claim 1 wherein said means for mounting said housing on an upright support surface comprises:

a bracket formed of a central spine having an upper end, a lower end and a front surface, a cross member at the upper end and the lower end, said cross member having a plurality of slots that receive fasteners to attach the bracket to a wall;

at least one adjustable clamp on the front surface of said spine for releasably gripping said housing.

5. The wall-mounted dryer according to claim 1 wherein said means for mounting said housing on an upright support surface comprises:

a bracket formed of a central spine having a front surface, a rear surface and an upper end;

a plurality of tabs on the rear surface of the spine;

at least one adjustable clamp on the front surface of said spine for releasably gripping said housing;

a receiver plate having an L-shaped latch on an upper end that grips an upper edge of a door, and a plurality of cavities longitudinally formed thereon that are positioned and dimensioned to receive the tabs on said spine.

6. The wall-mounted mirror according to claim 1 wherein said means for mounting said housing on an upright support surface comprises:

a bracket formed of an elongated receiver plate having a cross member at an upper end and a lower end, said cross member having a plurality of slots that receive fasteners to attach the bracket to a wall, said receiver plate further having cavities longitudinally disposed thereon;

a central spine having a front surface, a rear surface and an upper end;

a plurality of tabs on the rear surface of said spine that fit within the slots on said receiver plate;

at least one adjustable clamp on the front surface of said spine for releasably gripping said housing.

* * * * *